US005989644A

United States Patent [19]

Williams

[11] Patent Number: 5,989,644

[45] Date of Patent: Nov. 23, 1999

[54] PAINTING APPARATUS AND METHOD

[75] Inventor: Terry L. Williams, Twin Lakes, Mich.

[73] Assignee: Adac Plastics, Inc., Grand Rapids, Mich.

[21] Appl. No.: 09/094,914

[22] Filed: Jun. 12, 1998

[51] Int. Cl.[6] ..... B05D 1/02; B05B 13/02; B05B 3/00

[52] U.S. Cl. ..... 427/424; 427/421; 427/425; 118/321; 118/323

[58] Field of Search ..... 427/421, 424, 427/423; 118/321, 323, 326

[56] References Cited

U.S. PATENT DOCUMENTS

| | | | |
|---|---|---|---|
| 2,425,652 | 8/1947 | Starkey | 117/17 |
| 2,565,263 | 8/1951 | Paasche | 91/45 |
| 2,632,716 | 3/1953 | Starkey | 117/93 |
| 3,296,999 | 1/1967 | Gamble | 118/2 |
| 3,379,377 | 4/1968 | Ripple | 239/186 |
| 3,513,808 | 5/1970 | Mortimar et al. | 118/9 |
| 3,517,645 | 6/1970 | Klein, Jr. | 118/301 |
| 4,082,870 | 4/1978 | Yenni | 427/425 |
| 4,239,015 | 12/1980 | Novello et al. | 418/321 |
| 4,448,821 | 5/1984 | Buschor | 427/424 |
| 4,513,682 | 4/1985 | Otocki | 118/322 |
| 4,596,718 | 6/1986 | Gruner | 427/34 |
| 5,209,181 | 5/1993 | Flood | 118/322 |
| 5,518,543 | 5/1996 | Pietrowski et al. | 118/313 |

OTHER PUBLICATIONS

Sketch showing Paint Spray Installation at Muskegon, Michigan plant of ADAC Plastics, Inc. in operation since Oct. of 1994. (No date).

*Primary Examiner*—Shrive Beck
*Assistant Examiner*—Jennifer Calcagni
*Attorney, Agent, or Firm*—Young & Basile, P.C.

[57] ABSTRACT

A spray painting apparatus and methodology. A plurality of parts are loaded onto a carrier at circumferentially spaced locations about a central spin axis of the carrier whereafter the carrier is moved in indexing fashion to a spray station where drive means engage the carrier to spin the carrier about its spin axis while a spray gun assembly is moved up and down in reciprocal fashion parallel to the spin axis. The parts are mounted on the carrier in a fashion to simulate impellers which have the effect of sucking air into the center region of the carrier to augment painting of the interior surfaces of the parts. The carriers are preferably moved to the paint spray station by a power and free conveyor system wherein the carrier is disengaged from the power conveyor at the paint spray station and is reengaged with the power conveyor following spinning movement of the carrier and reciprocal movement of the spray gun assembly.

15 Claims, 7 Drawing Sheets

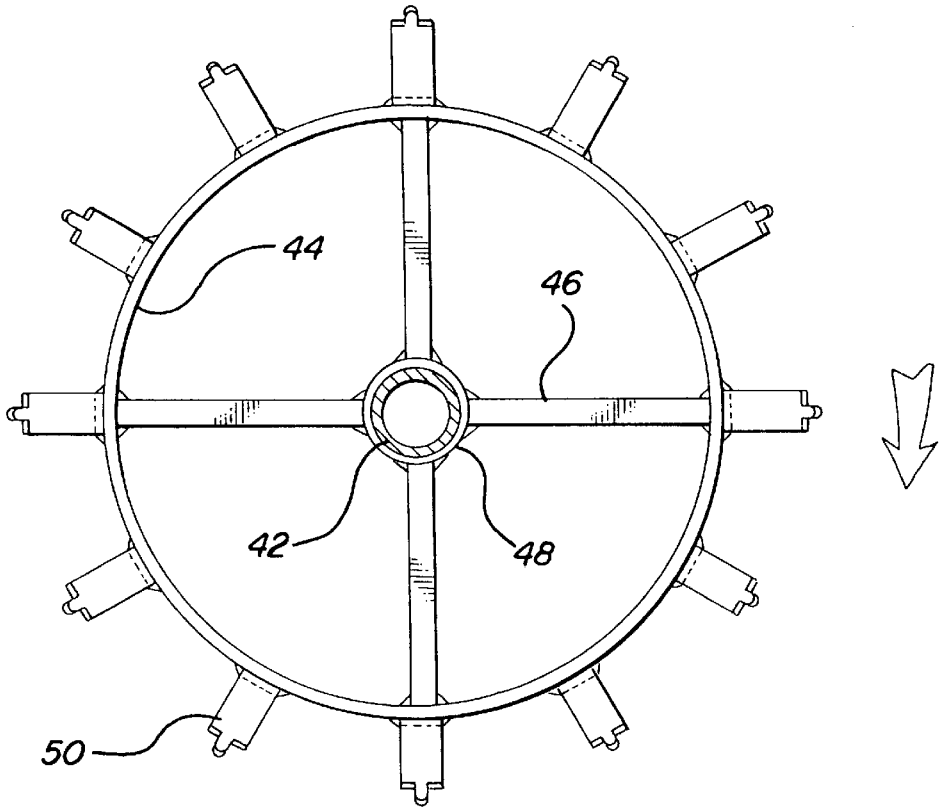
FIG-8
FIG-10
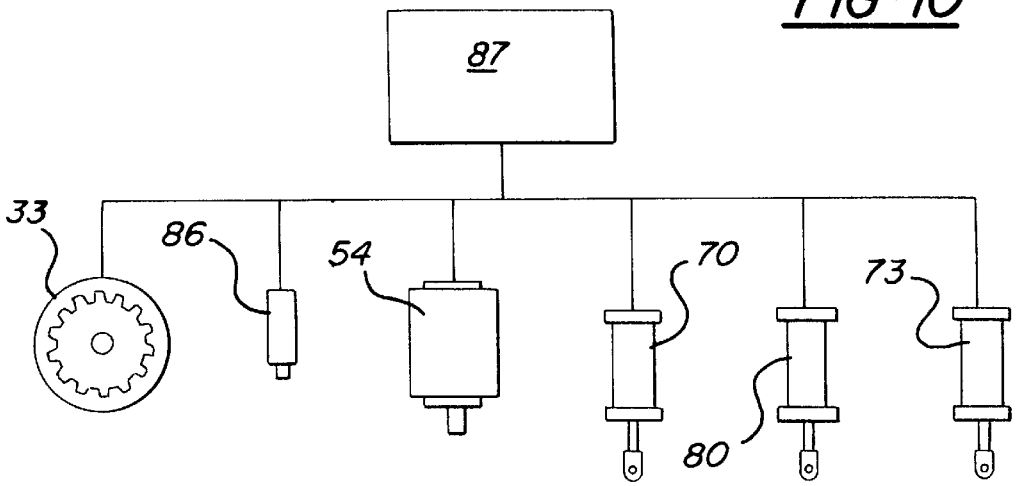

PAINTING APPARATUS AND METHOD

BACKGROUND OF THE INVENTION

This invention relates to apparatus and method for coating parts and more particularly to apparatus and method for spray painting parts.

Most parts in modern industrial equipment require some manner of coating or painting to optimize the appearance of the part and/or to protect the part. Many techniques are available for painting parts. Whereas the many available techniques are generally satisfactory in painting parts having only exterior surfaces to be painted or having interior surfaces that are simple and readily accessible, none of the prior art painting techniques provide smooth, even, consistent painting with respect to all surfaces on an intricate part including intricate, blind interior surfaces.

SUMMARY OF THE INVENTION

This invention is directed to the provision of improved painting apparatus and methodology.

More specifically, this invention is directed to the provision of an improved painting apparatus and methodology whereby a smooth, even coating may be consistently and uniformly applied even to intricate interior surfaces.

The invention paint apparatus and methodology is intended for applying smooth uniform even coating to a part having an intricate interior surface configuration including blind surface characteristics.

According to the invention methodology, a path of linear movement is established; a plurality of carriers are mounted for movement along the linear path; each carrier is mounted for spinning movement about a spin axis transverse to the linear path and typically vertical; one or more paint spray stations are established along the linear path; a spray gun is provided at each of the spray stations; several parts to be painted are loaded onto each carrier at a plurality of locations positioned radially outwardly of the spin axis of the carrier and spaced circumferentially around the carrier; a loaded carrier is moved along the linear path to a spray station; the loaded carrier is stopped at a spray station; the loaded carrier is spun at the spray station about its spin axis while paint is dispensed in spray form from the spray gun toward the parts on the spinning carrier; the spinning movement of the loaded carrier is thereafter allowed to stop; and movement of the loaded carrier along the linear path is thereafter resumed. This methodology provides a high throughput of painted parts while ensuring thorough painting of both interior and exterior surfaces of the parts and reducing the amount of linear space required to process a given quantity of product.

According to further feature of the invention, a multiplicity of parts are mounted in close circumferential relation about the entire circumference of each carrier. This arrangement increases the throughput of the methodology and has the effect of causing paint particles to dwell in the interior of the spin volume, a phenomenon which has been found to enhance the deposition of paint on interior surfaces of the parts.

According to further feature of the invention, each part is elongated and is positioned with its primary axis generally parallel to the spin axis; each part presents a surface that intersects a circular line centered on the spin axis; and the part surfaces are uniformly spaced and generally parallel to create angled impeller surfaces spaced circumferentially around the spin axis. With this arrangement, the impellers defined by the parts are operative to suck paint laden air into the center of the carrier to facilitate painting of interior surfaces of the parts.

According to further feature of the invention, a spray gun is mounted at a spray station for reciprocal movement along a gun path generally parallel to but spaced laterally from the spin axis of a carrier positioned at the spray station; the reciprocal movement of the spray gun along the gun path is commenced upon commencement of the spinning of the loaded carrier; the reciprocal movement of the spray gun along the gun path is stopped; and the spinning movement of the loaded carrier is stopped. The combined reciprocal movement of the spray gun and the spinning movement of the carrier provides thorough coverage to both interior and exterior surfaces on the spinning parts and also allows increased part height.

The invention apparatus includes means defining a linear path; a spray gun stationed along the linear path; a plurality of carriers mounted for successive movement along the linear path to the paint spray station, each mounted for spinning movement about a spin axis transverse to the linear path and each defining several part loading locations at circumferentially spaced locations about the spin axis for respective receipt of several parts to be painted; a spray gun at a spray station mounted for reciprocal movement along a gun path generally parallel to but spaced laterally from the spin axis of a carrier positioned at the spray station; and means operative to spin a loaded carrier positioned at the spray station about its spin axis while moving the spray gun reciprocally along the gun path and dispensing paint in spray form from the spray gun onto the parts on the spinning carrier. This apparatus provides a high throughput while ensuring and enhancing total coverage of both interior and exterior surfaces on the parts.

According to further feature of the invention, the apparatus includes a power conveyor moveable along a linear path; a paint spray station proximate the linear path; a plurality of spaced carriers mounted for movement along the linear path, each rotatable about a spin axis generally transverse to the linear path, and each defining a plurality of part loading positions at circumferentially spaced locations about the spin axis for respective receipt of a plurality of parts to be painted; means operative to selectively drive the carriers from the power conveyor along the linear path to move the respective carriers successively along the linear path to the spray station; a spray gun at the spray station moveable reciprocally along a gun path generally parallel to the spin axes of the carriers; and drive means operative to rotate a loaded carrier positioned at the spray station about its spin axis while moving the spray gun in reciprocal fashion along the gun path. This arrangement allows the individual loaded carriers to be brought to the paint spray station, released from the power conveyor, spun in coordination with the reciprocating spray gun, and thereafter reunited with the power conveyor to allow a new loaded carrier to be brought into the spray station.

BRIEF DESCRIPTION OF THE DRAWINGS

FIG. 8 is a detail view of a carrier utilized in the invention apparatus;

FIG. 10 is a schematically illustrated control system for the invention painting apparatus.

DETAILED DESCRIPTION OF THE PREFERRED EMBODIMENT

Figure 1:
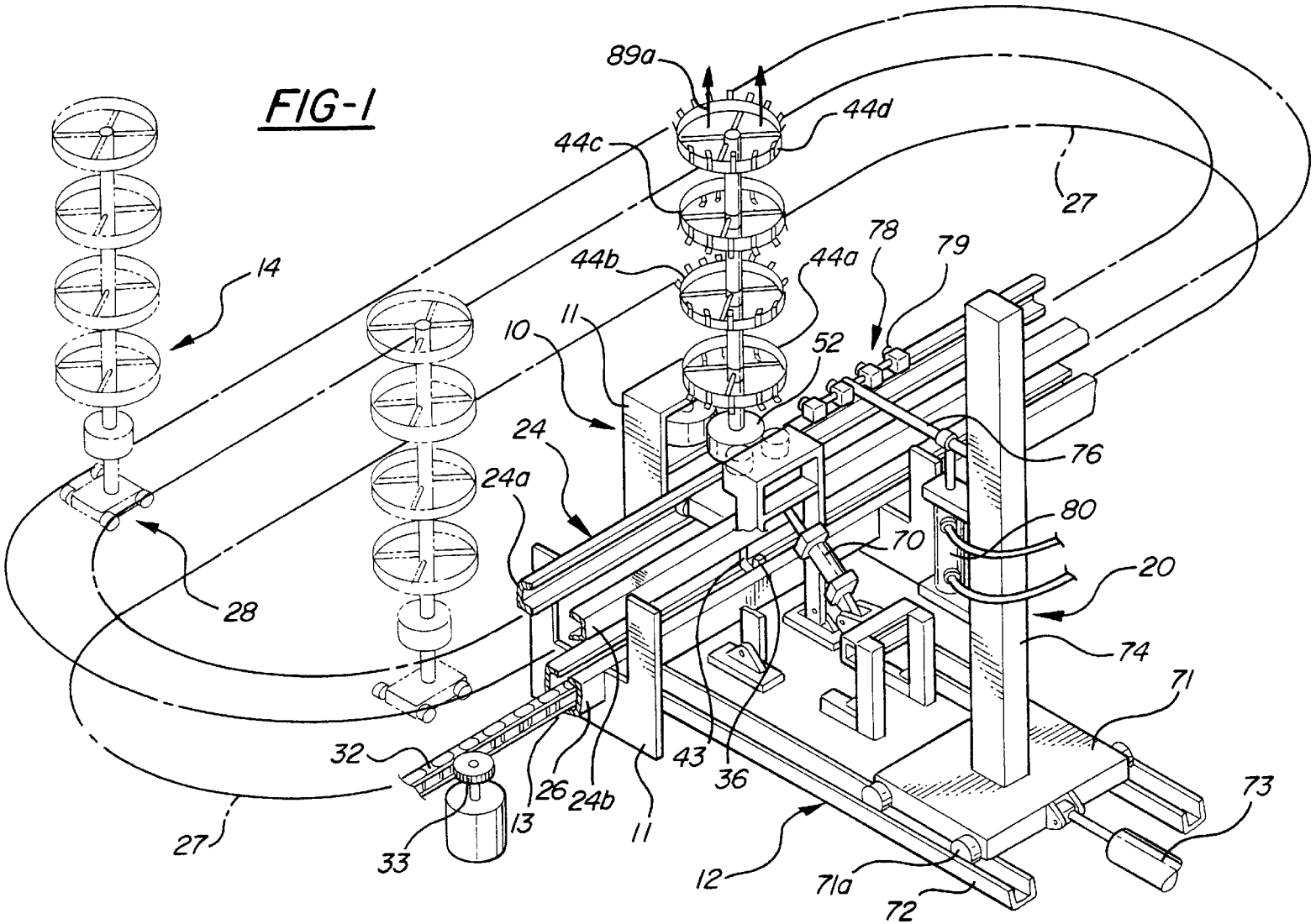
FIG. 1 is a fragmentary perspective view of a painting apparatus according to the invention.
Figure 3:
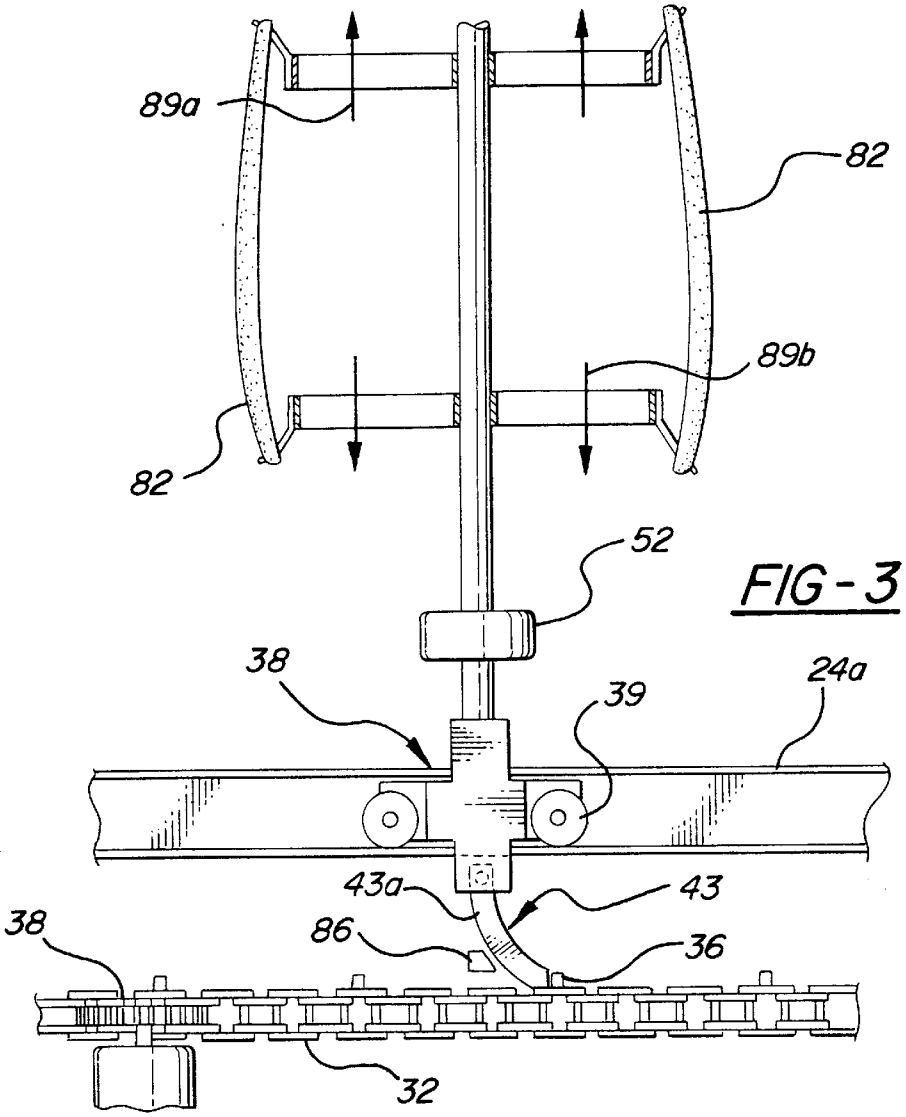
FIG. 3 is a fragmentary elevational view showing the coaction of a power and free conveyor utilized in the invention apparatus.
Figure 2:
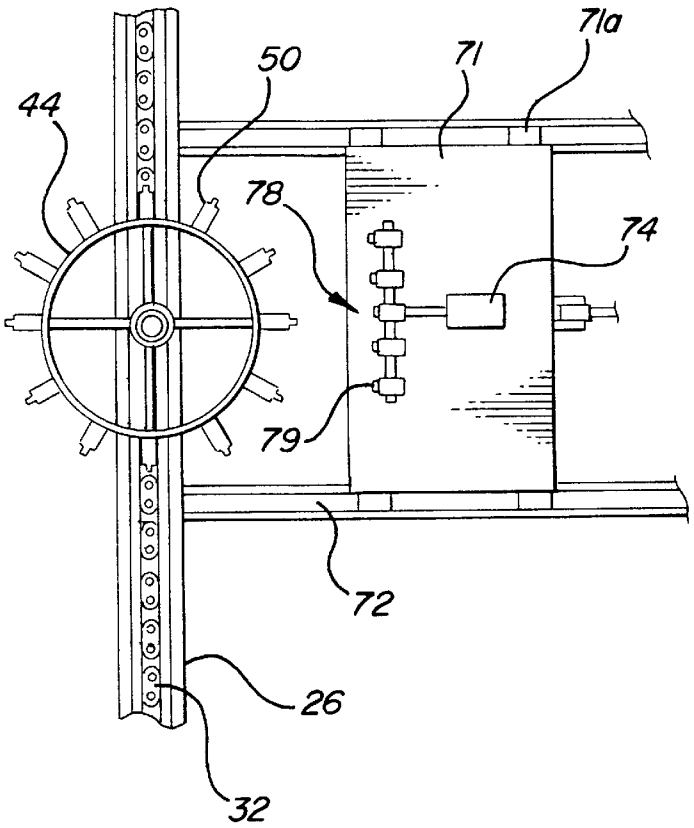
FIG. 2 is a fragmentary plan view of the apparatus.

The invention painting apparatus 10, broadly considered, includes a frame structure 11, a paint spray station 12, a conveyor assembly 13, a plurality of carrier assemblies 14, a spin assembly 16, a clamp assembly 18, and a spray gun assembly 20.

Conveyor assembly 13 comprises a power and free conveyor system and includes an upper conveyor track 24 supported on frame 11 and a lower conveyor track 26 supported on frame 11 beneath upper track 24. Tracks 24/26 are arranged as shown in dash lines in FIG. 1 to define and extend along a closed loop linear path 27 leading for example from a load/unload station 28 to the paint spray station 12 and then back to the load/unload station. A lower power chain link conveyor 32 is positioned on edge and guided in lower track 26 beneath upper track 24. Lower power conveyor 32 is continuously driven by a schematically shown powered sprocket 33. Lower power conveyor 32 includes a plurality of lugs 36 provided on the upper edge of conveyor 32 at longitudinally spaced intervals along the conveyor.

A plurality of carrier assemblies 14 are provided at spaced locations along conveyor assembly 13. Each carrier assembly 14 includes a trolley 38 rollably guided by wheels 39 in the laterally spaced left and right channel rails 24*a* and 24*b* of upper track 24; a bushing structure 40 provided centrally of the trolley; a spindle 42 received at a lower end 42*a* thereof in the bushing structure 40 whereby the spindle is free to rotate in the bushing structure 40; a dog 43 pivotally mounted at its upper end 43*a* on the lower side of trolley 38 and including a free lower end 43*b* for selective driving engagement with lugs 36 on conveyor 32; a plurality of vertically spaced hoops 44 positioned concentrically on the spindle and connected to the spindle by spokes 46 emanating from hubs 48 and fixedly secured to the spindle at vertically spaced locations; and a plurality of spring clips 50 positioned on the exterior circumference of each hoop 44 at closely spaced, circumferentially spaced locations about the hoop. Lower hoops 44*a* and 44*b* coact to define a first lower tier for the carrier and upper hoops 44*c* and 44*d* coact to define a second upper tier for the carrier. Each carrier assembly 14 further includes a wheel 52 fixably positioned concentrically on the spindle between trolley 38 and lowermost hoop 44*a*.

Spin assembly 16 includes a motor 54 secured to frame 11 and driving a speed reducer 56 having an output shaft 56*a;* a coupling 58; a drive shaft 60; upper and lower bearing 62/64 carried by frame 11; and a drive roller 66 positioned between upper and lower bearings 62/64. It will be seen that energization of motor 54 has the effect of rotating drive roller 66 about the axis of shaft 60.

Figure 4:
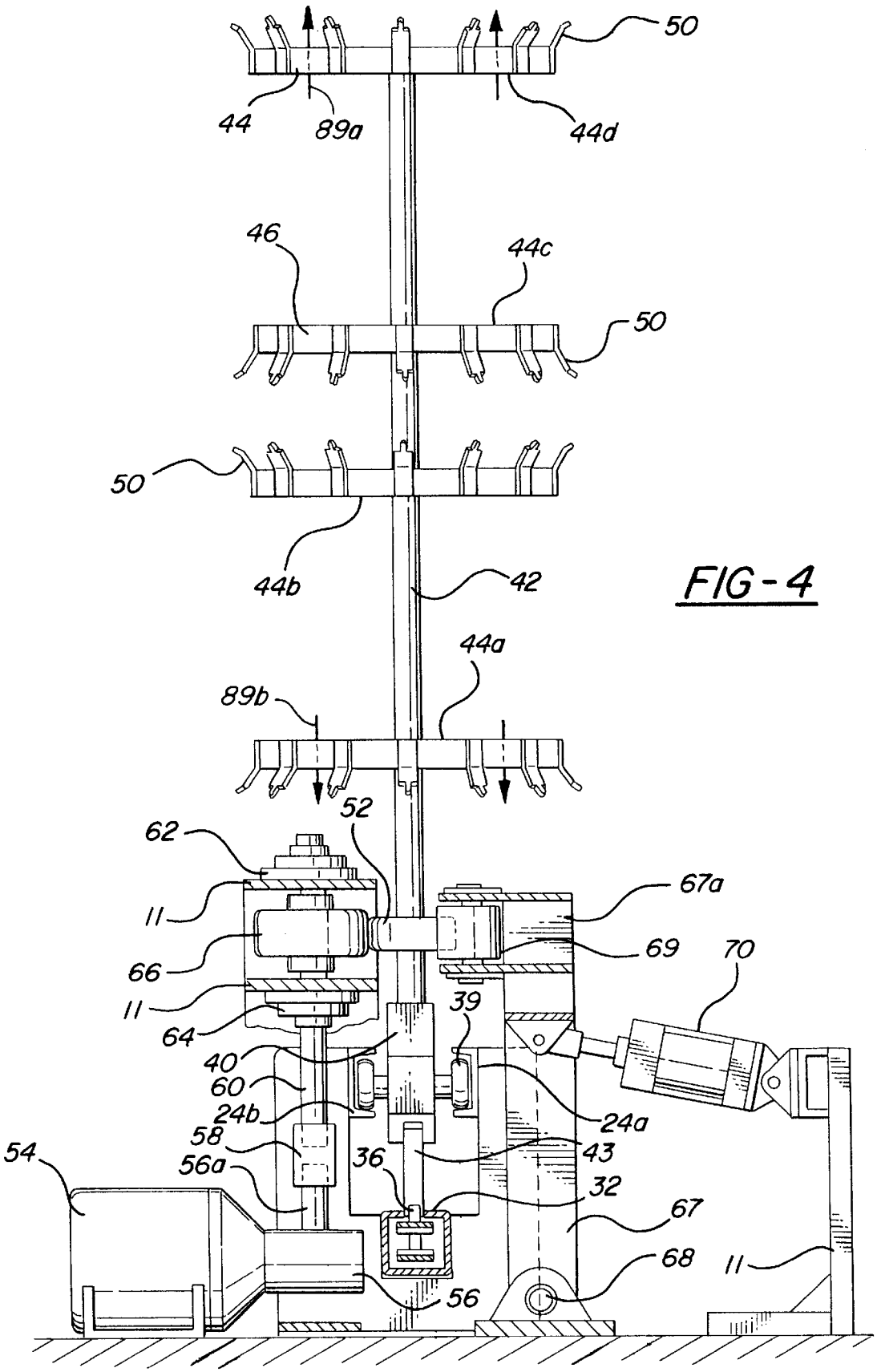
FIGS. 4, 5, 6 and 7 are partial views illustrating the operation of the apparatus at a paint spray station.
Figure 5:
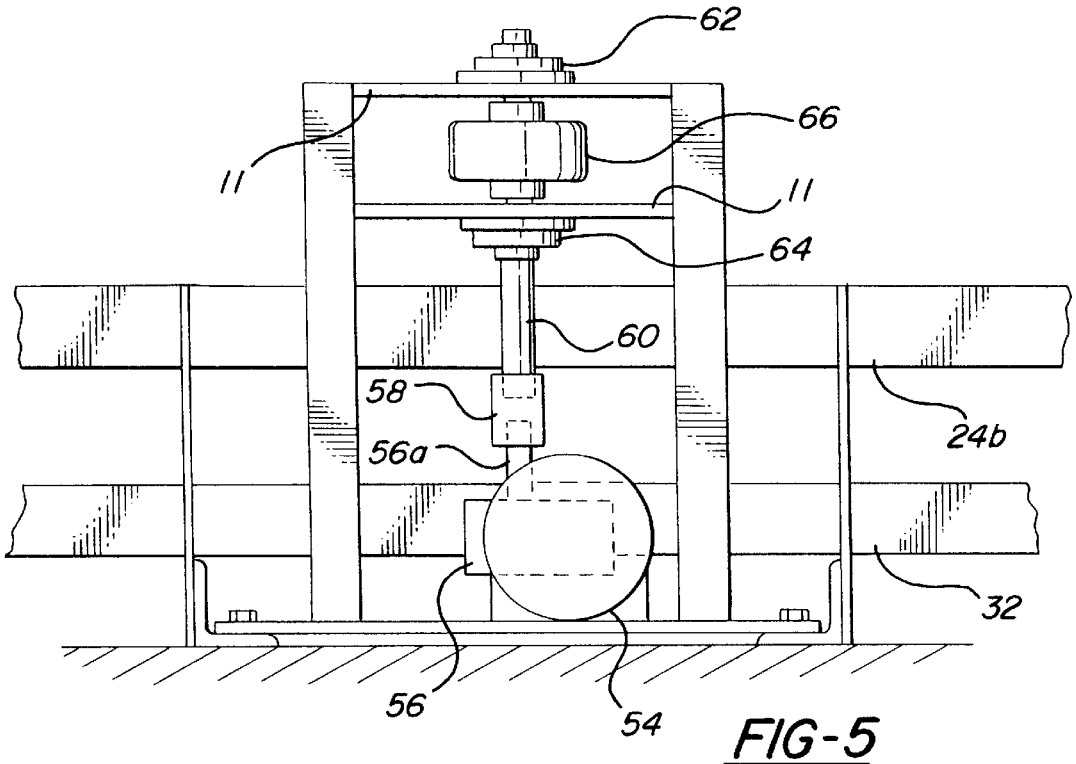
Figure 6:
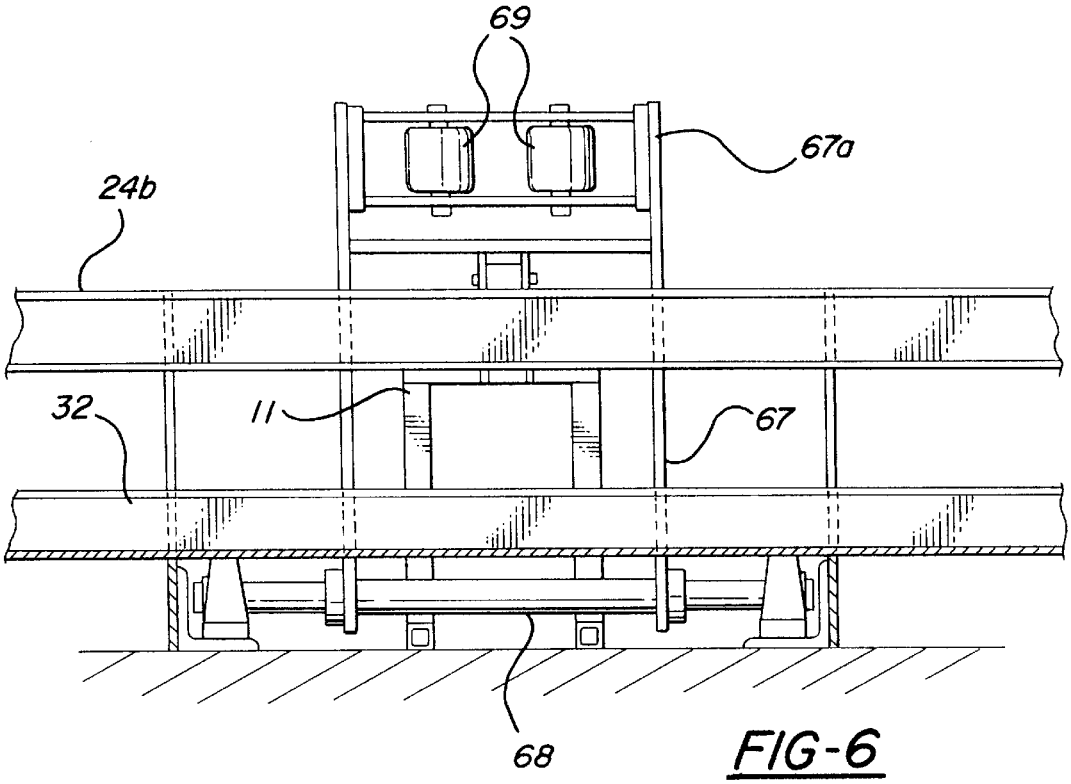

Clamp assembly 18 includes a lever 67 pivoted at 68 on frame 11; a pair of clamping rollers 69 carried at the upper end 67*a* of lever 67; and a hydraulic cylinder 70 extending between frame 11 and lever 68 and operative when actuated to pivot lever 67 about pivot axis 68 between an operative clamping position seen in solid lines in FIG. 4 and an inoperative, unclamped position seen in dash lines.

Spray gun assembly 20 includes a carriage 71 mounted at spray station 12 by wheels 71*a* for movement along a track 72 (by a hydraulic cylinder 73 or other suitable actuating device) in a direction transverse to linear path 27; a post 74 upstanding from carriage 71; a bracket structure 76 mounted on post 74 for reciprocal vertical movement with respect to the post; a spray gun assembly 78 carried by bracket structure 76 and including a plurality of spaced, adjustable spray guns 79; and an actuating mechanism (such as the schematically illustrated hydraulic cylinder 80) for moving the bracket structure 76 and thereby the spray gun assembly 78 in up and down, reciprocal fashion with respect to post 74. The spin axis of shaft 60, the spin axis of the spindle 42 of a carrier positioned at the paint spray station 12, and the central vertical axis of post 74 are aligned along a line extending generally transverse to linear path 27.

Operation

The operation of the invention will be illustrated in association with the painting of trunk finishers 82 adapted for application to the deck lid or trunk of a motor vehicle as a part of the deck lid finishing operation.

Figure 9:
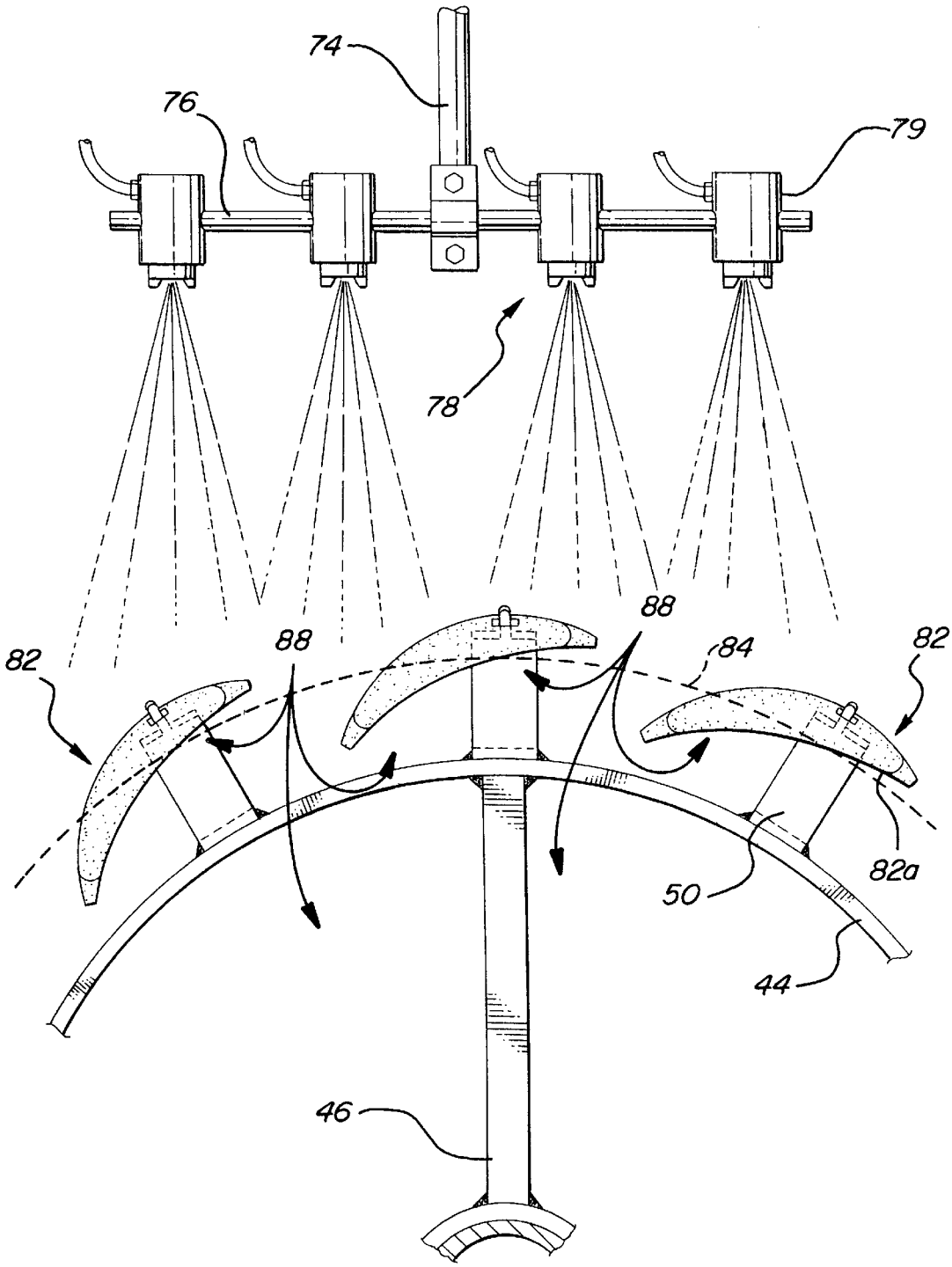
FIG. 9 is a detail view showing the loading of parts onto the carrier.

At the loading station 28 a plurality of trunk finishers 82 are loaded onto a carrier 14 and the loaded carrier is thereafter moved by conveyor assembly 13 around the path 27 in successive indexing steps until the carrier arrives at the paint spray station 12. The trunk finishers 82 are loaded at the loading station 28 in two tiers with the lower tier comprising a set of circumferentially spaced finishers 82 arranged in tightly spaced circumferential fashion about lower hoops 44*a*/44*b* utilizing downstanding spring clips 50 on the lower hoop 44*a* engaging a lower portion of each trunk finisher and upstanding spring clips 50 on the upper hoop 44*b* engaging an upper portion of each trunk finisher 82 so that the trunk finishers are arranged with their primary axes extending parallel to the vertical axis of the spindle 42. In a similar manner, another circumferentially spaced set of trunk finishers 82 is arranged between the upper hoops 44*c*/44*d* with the spring clips 50 on the lower hoop 44*c* engaging a lower portion of each trunk finisher and the spring clips 50 on the upper hoop 44*d* engaging an upper portion of each spring finisher. Preferably, as best seen in FIG. 9, the spring clips are arranged and configured so as to mount each trunk finisher in an angled disposition relative to a circle 84 centered on the spindle axis so that each part presents a surface 82*a* that intersects the circle to define an angled impeller surface and the circumferentially spaced parts coact to define angled impeller surfaces spaced circumferentially around the spin axis and operative to cause paint particles to dwell in the center of the carrier thereby to enhance the deposition of paint on interior surfaces of the parts. This dwell phenomenon is a result of the spinning of the parts and is not caused by auxiliary nozzles or other air flow devices.

After the carrier is loaded at the loading station, the carrier moves around in indexing fashion until it reaches the paint spray station 12. The indexing movement of the carriers around the path is accomplished by the power and free conveyor assembly 13 and, specifically, is accomplished by the engagement and disengagement of the dogs 43 on the carriers with the lugs 36 on the power conveyor in response to solenoid actuated cam mechanisms 86 inserted into the path of dogs 43 as a carrier reaches the paint spray station to disengage the dogs from the associated lugs 36 on the power conveyor. It will be understood that as a carrier 14 arrives at the paint spray station that carrier's dog 43 is disengaged by a cam mechanism 86 from its associated lug 36 on the power conveyor so that the carrier may remain in a stopped position at the paint spray station while the power conveyor continues to run. Once a carrier 14 has arrived at and stopped at the paint spray station 12, the carrier is clamped by clamp assembly 18 and spun about the vertical axis of the carrier spindle and paint is sprayed onto the spinning carrier as the paint spray guns 78 are moved in reciprocal fashion up and down relative to post 74. The spin speed is substantially greater than the reciprocation speed.

In overview, and as seen schematically an FIG. 10, a controller 87 serves to coordinate and control the various components of the painting apparatus. Specifically, controller 87 operates to provide power to sprocket 33 whereby to drive power conveyor 32 continuously; controller 87 intermittently actuates cams 86 to drive carriers 14 in an indexed intermittent manner from power conveyor 32; controller 87 energizes motor 54 continuously so that drive wheel 66 spins continuously; controller 87 actuates power cylinder 80 intermittently so that spray gun assembly 78 is reciprocated intermittently; and controller 87 actuates power cylinder 70 intermittently so that clamp assembly 18 is actuated intermittently. Carriage 71 remains stationary during the course of a given painting job but may be adjusted by controller 87 via cylinder 73 as needed.

With this controller arrangement, as the carrier arrives at the paint spray station, wheel 52 on the carrier spindle moves into engagement with continuously rotating wheel 66 of the spin assembly and simultaneously cylinder 70 is actuated to move clamp lever 67 from the dash line position of FIG. 4 to the solid line position of FIG. 4 in which clamp or idler rollers 69 clamp against circumferentially spaced locations on wheel 52 in opposition to drive wheel 66 to firmly press wheel 52 against spinning wheel 66 so as to firmly impart the spinning motion of wheel 66 to spindle wheel 52 and spin the carrier about the vertical axis of the spindle. To insure positive drive as between wheel 66 and wheel 52, wheel 66 is desirably made of a rubber or other resilient material for engagement with a steel spindle wheel 52.

At the same time as clamp rollers 69 are moving into clamping engagement with spindle wheel 52, controller 87 operates to insert a cam 86 into the path of the carrier dog 43 whereby to pivot the dog upwardly and disengage the carrier from power conveyor 32 and halt the movement of the carrier at the paint spray station. Simultaneously, controller 87 operates to actuate power cylinder 80 to move the spray guns in reciprocal fashion relative to post 74. Whereas these spray guns might be moved through several up and down cycles during the spinning of a carrier at the paint spray station, it has been found satisfactory for most painting operations to move the paint spray guns through one complete up and down cycle as the carrier is spun. Once the paint spray guns have been moved up and down through a complete cycle, controller 87 operates to withdraw the clamp assembly 18 to terminate spinning of the carrier, and withdraw cam 86 to allow carrier dog 43 to reengage with a lug 36 on the power conveyor to resume the powered movement of the carrier along linear path 27. Each carrier will eventually, following several indexing moves of the system, arrive at the load/unload station 28 where the painted parts 82 may be unloaded and further parts 82 to be painted loaded onto the carrier for subsequent movement around the path to the paint spray station.

Figure 7:
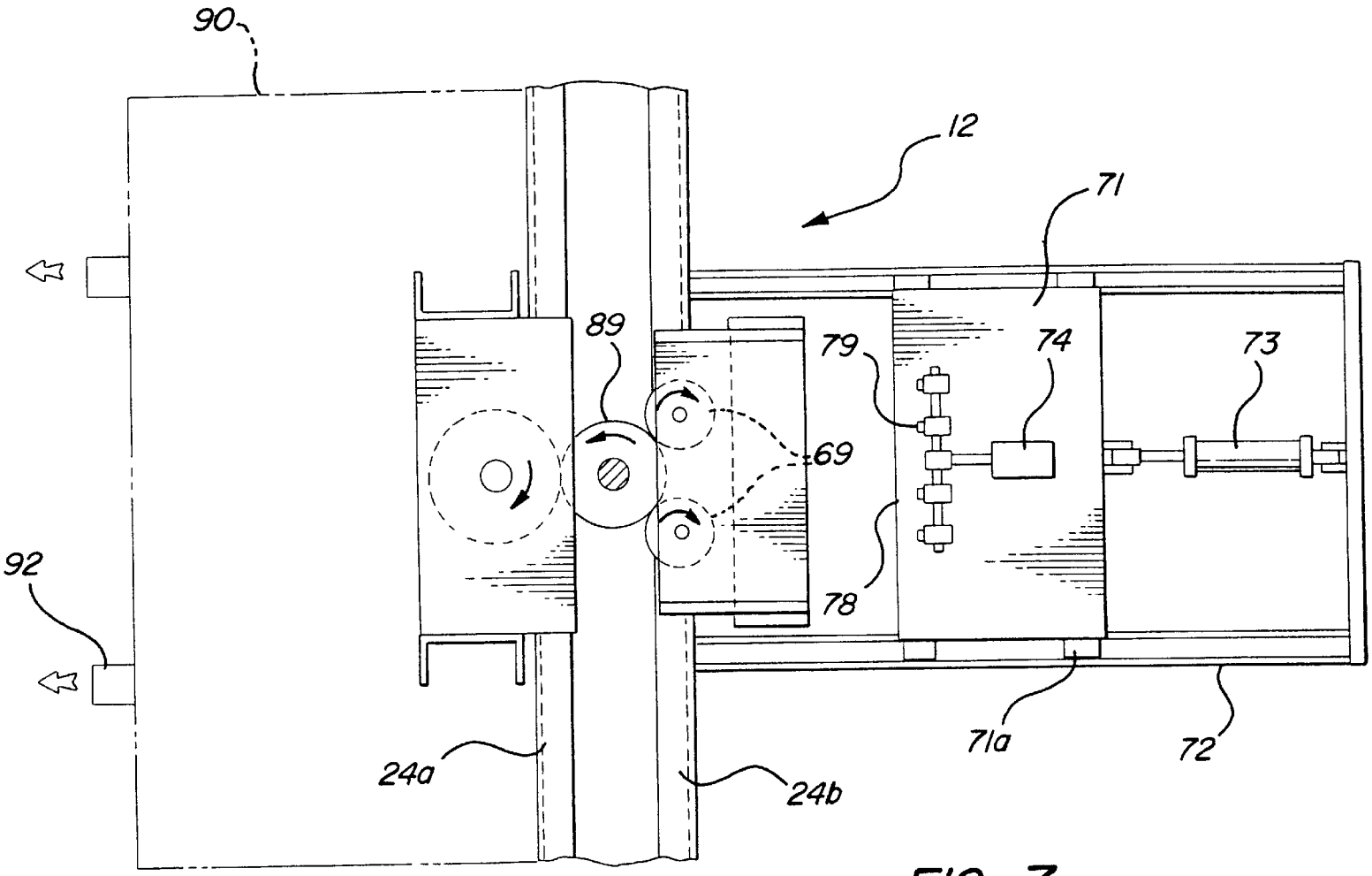

The herein described painting apparatus and methodology has been found to provide a high part throughput while insuring complete paint coverage on both exterior and interior surfaces of the parts including even intricate blind surfaces on the interior surfaces of the parts. These superior results are believed to be due to a venturi action created by the angled impellers simulated by the angled parts 82 so that the paint laden air from the spray guns is caused to flow into the volume (in the manner shown by the arrows 88 in FIG. 9) between each set of parts 82 and to dwell in this volume and hang in the air in such a way as to impact on the interior surfaces and seek out even intricate blind configurations on the interior surfaces for total paint coverage, whereby to achieve excellent paint coverage and insure that a very large percentage of the paint ends up on the parts being painted. After the paint has entered into the interior of the rotating carrier it has been found that the paint thereafter forms itself into an upwardly moving column 89*a* and a downwardly moving column 89*b* which exit the upper and lower ends of the spinning carrier respectively and which are believed to further augment the painting process with respect to the interior surfaces of the rotating parts. It will be understood that the paint spray station 12 would normally be defined by a paint spray booth 90 seen in FIG. 7 and that, if desired or required, means 92 might be provided to draw paint laden air out of the booth.

Whereas the operating parameters of the system will of course vary depending on the nature and configuration of the parts being painted and the desired throughput, in a particularly effective system operation, the carriers were spun at 175±5 rpm with variable speed control and the spray gun assembly was moved through an up and down cycle totalling 108 inches in 18 seconds.

Whereas a preferred embodiment of the invention has been illustrated and described in detail it will be apparent that various changes may be made in the disclosed embodiment without departing from the scope or spirit of the invention. For example, although each carrier is illustrated and described as having only 2 tiers accommodating 2 circular tiers of parts, it would be possible and feasible to construct and operate carriers having more than two tiers. Further, although the operation is described utilizing parts defining an impeller blade effect, the scoop effect may also be created by providing dispensable fins on each part and/or by providing fins on the spokes or hoops of the rack. In overview, it has been found that by varying the orientation of multiple parts on a rotating part rack the transfer efficiency of the paint can be enhanced. Careful and controlled part orientation along with air flow enhancement devices on either the part and/or the rack enables the invention apparatus and methodology to overcome prior art paint coverage problems with respect to interior blind holes, interior blind corners, and similar intricate interior part configurations.

I claim:

1. A method of painting parts comprising:

establishing a path of linear movement;

mounting a plurality of carriers for movement along the linear path;

mounting each carrier for a spinning movement about a spin axis transverse to the linear path;

establishing a paint spray station along the linear path;

providing a spray gun at the spray station;

at a loading station spaced along a linear path before the paint spray station, loading several parts to be painted onto each carrier at a plurality of locations positioned radially outwardly of the spin axis of the carrier and spaced circumferentially around the spin axis of the carrier;

moving a loaded carrier along the linear path from the loading station to the spray station;

stopping the movement of the loaded carrier along the linear path at the spray station;

spinning the loaded carrier at the spray station about its spin axis while dispensing paint in spray form from the spray gun onto the parts on the spinning carrier;

causing the spinning movement of the loaded carrier to stop; and thereafter resuming the movement of the loaded carrier along the linear path to an unloading station beyond the paint spray station while bringing a successive loaded carrier into position at the spray station for painting of the parts carried thereby.

2. A method according to claim 1 wherein a multiplicity of parts are mounted in close circumferential relation about the entire circumference of the carrier.

3. A method according to claim 2 wherein each part is elongated and is positioned with its primary axis generally parallel to the spin axis.

4. A method according to claim 3 wherein each part is positioned on the carrier so as to present a surface that intersects a circular line centered on the spin axis; and the part surfaces are uniformly spaced and generally parallel to create angled impeller surfaces spaced circumferentially around the spin axis and operative to suck paint laden air into the center of the carrier to facilitate painting of interior surfaces of the parts.

5. A method according to claim 1 wherein the method further comprises:

mounting the spray gun at the spray station for reciprocal movement along a gun path generally parallel to but spaced laterally from the spin axis of a carrier positioned at the spray station;

commencing reciprocal movement of the spray gun along the gun path upon commencement of the spinning of the loaded carrier; and stopping the reciprocal movement of the spray gun along the gun path; and causing the spinning movement of the loaded carrier to stop.

6. A method of painting parts comprising;

providing a power conveyor moveable along a linear path;

providing a carrier moveable along the linear path and rotatable about a spin axis generally transverse to the linear path;

providing a paint spray station proximate the linear path;

providing a spray gun at the spray station moveable reciprocally along a gun path generally parallel to the spin axis of the carrier;

at a loading station spaced along the linear path before the paint spray station, loading a plurality of parts to be painted on the carrier at circumferentially spaced locations about the spin axis of the carrier;

engaging the power conveyor with the loaded carrier and moving the loaded carrier along the linear path to the spray station;

disengaging the power conveyor from the loaded carrier to stop the loaded carrier at the spray station;

rotating the loaded carrier about its spin axis while moving the spray gun in reciprocal fashion along the gun path;

stopping the rotation of the carrier and stopping reciprocal movement of the gun; and reengaging the power conveyor with the loaded carrier to resume movement of the carrier along the linear path away from the spray station to an unloading station spaced along the linear path beyond the paint spray station.

7. A method according to claim 6 wherein a multiplicity of parts are mounted in close circumferential relation about the entire circumference of the carrier.

8. A method according to claim 7 wherein each part is elongated and is positioned with its primary axis generally parallel to the spin axis of the carrier.

9. A method according to claim 8 wherein each part is positioned on the carrier so as to present a surface that intersects a circular line centered on the spin axis of the carrier; and the part surfaces are uniformly spaced and generally parallel so as to create impeller surfaces spaced circumferentially around the spin axis of the carrier operative to suck paint laden air into the center of the carrier to facilitate painting of interior surfaces on the parts.

10. An apparatus for painting parts comprising:

means defining a linear path;

a paint spray station along the linear path;

a plurality of carriers mounted for successive movement along the linear path from a loading station to the paint spray station, each mounted for spinning movement about a spin axis transverse to the linear path and each defining several part loading locations at circumferentially spaced locations about the spin axis for respective receipt of several parts to be painted;

a spray gun at the spray station mounted for reciprocal movement along a gun path generally parallel to but spaced laterally from the spin axis of a carrier positioned at the spray station;

means operative to move a loaded carrier along the linear path from the loading station to the spray station;

means operative to stop the movement of the loaded carrier along the linear path at the paint spray station; and means operative to spin the loaded carrier stopped at the spray station about its spin axis while moving the spray gun reciprocally along the gun path and dispensing paint in spray form from the spray gun onto the parts on the spinning carrier.

11. An apparatus according to claim 10, wherein a multiplicity of part loading locations are provided in close circumferential relation about the entire circumference of each carrier.

12. An apparatus for painting parts comprising:

a power conveyor moveable along a linear path;

a paint spray station proximate the linear path;

a plurality of spaced carriers each moveable along the linear path, each rotatable about a spin axis generally transverse to the linear path, and each defining a plurality of part loading positions at circumferentially spaced locations about the spin axis for respective receipt of a plurality of parts to be painted;

means operative to selectively drive the carriers from the power conveyor along the linear path to move the respective carriers successively along the linear path to the spray station and stop the carrier at the spray station;

a spray gun at the spray station moveable reciprocally along a gun path generally parallel to the spin axes of the carriers; and drive means operative to rotate a loaded carrier stopped at the spray station about its spin axis while moving the spray gun in reciprocal fashion along the gun path.

13. A method for spray painting articles of manufacture comprising the steps of:

conveying a plurality of said articles as a group along a linear path to a spray station;

causing the plurality of said articles to travel in a circular path about a stationary spin axis which is proximate the spray station and which is central to said plurality while, at the same time, discharging paint from a spray nozzle adjacent but spaced from the articles and along a spray path which intersects the stationary spin axis; and, thereafter conveying the plurality of articles as a group along a linear path away from the spray station.

14. The method defined in claim 13 including the further step of reciprocating the nozzle along a path which is essentially parallel to the spin axis during the paint dispensing step.

15. The method defined in claim 14 wherein the speed of travel in the circular path is substantially greater than the nozzle reciprocating speed.

* * * * *